United States Patent [19]

Voegel et al.

[11] Patent Number: 4,557,817

[45] Date of Patent: Dec. 10, 1985

[54] REDUCED VOLTAGE ELECTRODE DESIGN

[75] Inventors: Robert L. Voegel; Kenton B. Wright, both of Newburgh, Ind.

[73] Assignee: Aluminum Company of America, Pittsburgh, Pa.

[21] Appl. No.: 670,078

[22] Filed: Nov. 13, 1984

[51] Int. Cl.[4] ..... C25D 17/12

[52] U.S. Cl. ..... 204/286; 204/67; 204/243 R; 204/294; 204/297 R

[58] Field of Search ..... 204/67, 243 R, 243 M, 204/244, 245, 246, 247, 280, 286, 294, 297 R

[56] References Cited

U.S. PATENT DOCUMENTS

| | | | |
|---|---|---|---|
| 1,036,654 | 8/1912 | Leffel | 204/286 |
| 2,528,905 | 11/1950 | Ollivier et al. | 204/243 |
| 2,594,881 | 4/1952 | De Quasie et al. | 204/286 |
| 2,624,703 | 1/1953 | Park | 204/247 |
| 3,280,231 | 10/1966 | Bentolila et al. | 264/29 |
| 3,707,764 | 1/1973 | Frankovich | 29/527.6 |
| 4,395,613 | 7/1983 | Barr et al. | 219/69 E |

FOREIGN PATENT DOCUMENTS

| | | | |
|---|---|---|---|
| 1187807 | 2/1965 | Fed. Rep. of Germany | 204/286 |
| 1,937,411 | 9/1971 | Fed. Rep. of Germany | 204/286 |
| 3,100,921 | 8/1982 | Fed. Rep. of Germany | 204/286 |
| 2051864 | 1/1981 | United Kingdom | 204/67 |
| 378524 | 6/1973 | U.S.S.R. | 204/286 |
| 537130 | 12/1976 | U.S.S.R. | 204/286 |
| 954522 | 8/1982 | U.S.S.R. | 204/286 |

*Primary Examiner*—G. L. Kaplan

*Attorney, Agent, or Firm*—Andrew Alexander; John P. Taylor

[57] ABSTRACT

An improved electrode assembly is provided for use in a cell for the production of metal by electrolytic reduction comprising a nonmetallic conductive electrode, such as a carbon electrode, having a top surface and a central current carrying support shaft received in a central bore extending axially downwardly from the top surface. Conductive fin assemblies extend radially from the central support shaft in the electrode, the fin assemblies comprising a plurality of gate members extending radially from the central shaft adjacent a top surface of the electrode and wing members extending from the gate members downwardly into the electrode from the top surface. Metal conductive means, comprising a metal which will not contaminate the molten salt bath, extend downwardly in the electrode beyond the depth of the central shaft and fin assemblies. Current passing to the electrode from the central shaft will, therefore, be distributed more evenly in the electrode to minimize the voltage drop in the electrode and permit the cell to run cooler and more efficiently. Preferably, at least some of the current distribution materials comprise the same metal being reduced in the electrolytic reduction cell.

22 Claims, 14 Drawing Figures

REDUCED VOLTAGE ELECTRODE DESIGN

BACKGROUND OF THE INVENTION

1. Field of the Invention

This invention relates to electrodes used in the production of metal in electrolytic reduction cells. More particularly, this invention relates to improvements in the current distribution through the electrode to reduce the electrode temperature and the voltage drop therein.

2. Description of the Prior Art

In the production of metal, such as aluminum, in an electrolytic reduction cell, electrodes are used which are constructed, principally, of conductive material, such as carbon, which will conduct the high currents used for the electrolytic reduction to the molten salt bath in the cells. Carbon electrodes are normally used to avoid contamination of the bath with foreign metals and lower reduction voltage.

The current is normally carried to the electrode by large conductor busses which, in turn, are directly connected to the electrode via a metal rod which, in the case of an anode, also functions as a mechanical support for the anrode as it is lowered or raised in the cell and as a cooling heat sink.

Conventionally, the electrode is attached to the metallic rod by inserting the rod into a central bore formed in the top of the electrode. An electrically conducting ram mix may then be placed into the space between the rod and the bore in the electrode. This connection, however, can be less than satisfactory both from a mechanical standpoint and electrically as well by providing a higher resistance at the interface. This problem has been partially addressed in the prior art. For example, German Pat. No. 1,187,807 discloses a carbon anode having one or more cavities to receive a metal stub or rod. The surfaces of the cavities have grooves or teeth to increase the surface area which is said to provide better conductivity of the current from the rod into the anode.

German Pat. No. 1,937,411 provides for a cast iron structure to be poured around a steel stub placed in the end of a carbon anode. The purpose of the cast iron structure apparently, is to spread the current distribution across the top surface of the anode, as well as to lock the metal rod or stub to the anode by providing an undercutting in the sidewall of the recess cut into the top surface of the anode to receive the molten cast iron. The cast iron, as it solidifies, then provides a dovetail-like fit in the anode to prevent or inhibit the stub from separating from the anode.

Such arrangements do provide better mechanical bonding between the steel support rod and the anode, as well as improving the current distribution in the area immediately surrounding the metal rod or across the upper surface of the anode.

Russian Pat. No. 378,524 illustrates a carbon electrode structure having the usual central bore to receive a metal stub and also having a series of holes drilled into the carbon block parallel to the central bore to receive cast iron rods. Openings are then cut into the carbon between the central bore and the cast iron rods to permit cast iron bridge pieces to be poured to connect the cast iron rods to the metal stub. The purpose of the rods is to reduce power losses.

Despite these attempts to distribute the current more evenly in the anode, there remains a problem, particularly when consumable electrode materials, such as carbon, are used because of the large resistance paths which must be traversed by the current from the metallic current distributing means adjacent the top of the electrode to the bottom of the electrode when the electrode is new. The mere extension of cast iron rods down in the electrode to attempt to bridge some of this distance may be self defeating in that the enhancement of the current carrying ability of the electrode by insertion of such rods, for example, down one third of the length of the electrode, can result in more frequent replacement of the anodes. This is because the electrode, once it is burned off to the point of reaching the metal rod, may need to be replaced if the cast iron, coming into contact with the bath, will result in impurities introduced into the bath. Thus, while such an extension of the current carrying ability would lower the resistance to the bottom of a new electrode, the same result could have been attained by simply shortening the electrode without any change in the useful life since, in both cases, the distance from the bottom of the electrode to the first occurrence of bare iron would have the same path length.

There, therefore, still remains a need for improvement in the current carrying capability of a nonmetallic electrode by better current distribution through the electrode without interfering with the useful life of the electrode by making less of the electrode usable.

SUMMARY OF THE INVENTION

It has been found that the foregoing problems may be overcome, at least in part, by providing current carrying metallic members in said electrode which are symmetrically spaced around the central support rod and include portions which extend downwardly into the electrode toward the bottom of the electrode. At least the portions which extend downwardly are constructed of a conductive material which will not contaminate the bath when the electrode burns away sufficiently to expose portions of the conductive material.

It is, therefore, an object of the invention to provide an electrode having improved current distribution characteristics.

It is another object of the invention to provide an electrode having improved current distribution characteristics wherein conductive means symmetrically spaced around the electrode support rod extend downwardly into the electrode to conduct the current downwardly toward the bottom of the electrode.

It is yet a further object of the invention to provide an electrode having improved current carrying capabilities wherein metallic conductive means symmetrically spaced around the central support shaft and extending downwardly into the electrode are constructed of a metal which will not contaminate the bath when the electrode burns back sufficiently to expose portions of the metallic conductive means.

These and other objects of the invention will be apparent from a reading of the description and accompanying drawings.

In accordance with the invention, an improved electrode assembly is provided for use in a cell for the production of metal by electrolytic reduction comprising a nonmetallic conductive electrode having a top surface and a central current carrying support shaft received in a central bore extending axially downward from the top surface. Conductive fin assemblies extend radially from the central support shaft in the electrode, the fin assemblies comprising a plurality of gate members extending radially from the central shaft adjacent a top surface of the electrode and wing members extending from the gate members downwardly into the electrode from the top surface, and metal conductive means, comprising a metal which will not contaminate the molten salt bath, extending downwardly in the electrode beyond the depth of the central shaft and fin assemblies, whereby current passing to the nonmetallic conductive electrode from the central shaft may be distributed evenly in the nonmetallic conductive electrode to minimize the voltage drop in the electrode from the top of the electrode to the bottom of the electrode thereby permitting the electrode to run cooler and more efficiently.

In a preferred embodiment, at least a portion of the metal conductive means comprise the same metal being reduced in the electrolytic reduction cell, e.g., aluminum materials are used in an aluminum reduction cell.

DESCRIPTION OF THE PREFERRED EMBODIMENTS

Figure 1A:
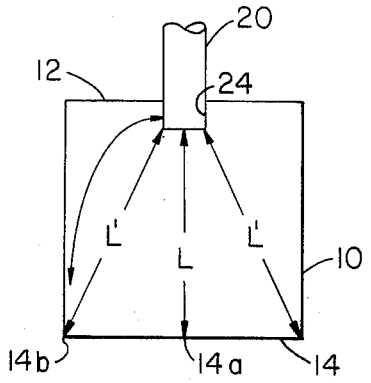
FIG. 1*a* is a schematic view generally representative of a prior art electrode.
Figure 1B:
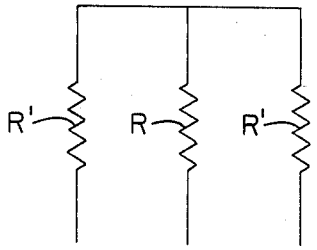
FIG. 1*b* is a schematic view of the electrical equivalence of the structure of FIG. 1*a*.

Referring now to FIGS. 1 through 3, the principles of the invention, in contrast to the prior art, are generally illustrated. The exact electrical equivalences of the prior art structures and those of the invention are extremely complex, and thus, FIGS. 1–3 are not to be taken as exact representations of the system. Rather, they are intended to be generally representative of the differences between the prior art and the structure of the invention for illustrative purposes. In FIG. 1*a*, a conventional carbon electrode 10 is shown having a central steel shaft 20 embedded in a bore 24 in top surface 12 of electrode 10. The current passing from shaft 20 through electrode 10 to the bottom surface 14 of the electrode, which will be in contact with a molten salt bath (not shown), must traverse a path of length L to point 14*a* in the middle of bottom surface 14. However, the current passing from shaft 20 through electrode 10 to point 14*b* on the edge of bottom surface 14 must traverse a longer path L'. This is illustrated in FIG. 1*b* as a resistance R representing the length L while resistors R', having a higher value, represent the distances L'. Because the resistances R' are somewhat larger than resistor R, a nonuniform current distribution is imposed across the surface 14 within the bath which results, in turn, in inhomogenity in the distribution of carbon dioxide bubbles in the bath across the surface 14.

Figure 2A:
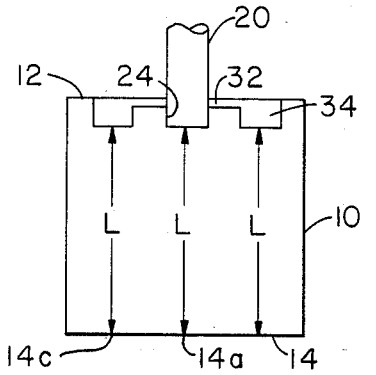
FIG. 2*a* is a schematic view generally representative of a variation of the prior art structure of FIG. 1*a*.
Figure 2B:
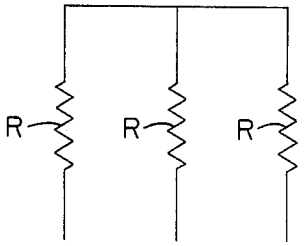
FIG. 2*b* is a schematic view of the electrical equivalence of the structure of FIG. 2*a*.

To cure or reduce this nonuniformity, prior art proposals have attempted to enlarge the metal contact area across top surface 12 as previously discussed with respect to German Pat. No. 1,937,411 and Russian Pat. No. 378,524. The effect of such approaches is illustrated in FIGS. 2*a* and 2*b*. When a metallic bridge or gate member 32 is attached to shaft 20 and, in turn, attached to a metallic wing member 34, the effect is to produce current paths of uniform length L, as shown in FIG. 2*a*, which are represented as uniform resistances R, as shown in FIG. 2*b*.

Figure 3A:
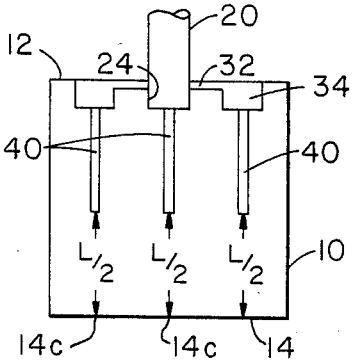
FIG. 3*a* is a schematic view generally representative of the electrode of the invention.
Figure 3B:
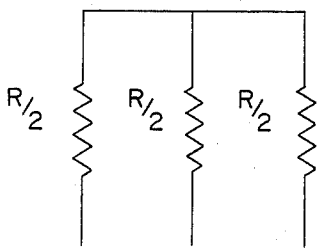
FIG. 3*b* is a schematic view of the electrical equivalence of the structure of FIG. 3*a*.

However, the result is still an unacceptably long current path of high resistance for the electrode, when new, prior to burn off of some of the electrode length. To address this problem, in accordance with the concepts of the invention, as shown in FIG. 3*a*, the structure of FIG. 2*a* is modified to include downwardly extending metal portions 40 which effectively extend metal portions 20, 32 and 34 of FIG. 2*a* downwardly to as much as one-half of the electrode length. Effectively then, the space from the metal conductor portion of the electrode through the nonmetallic portion, such as carbon, to bottom surface 14 may be effectively cut in half (if the length of the metal 40 represents one-half of the total length from member 34 to bottom surface 14). This, as shown in FIG. 3*b*, effectively reduces the resistance.

An important aspect of the present invention is the provision that metal portions or rods 40 be constructed of a metal which will not contaminate the bath when it comes in contact therewith. This becomes important as the electrode is used up and burned away. When the electrode burns down to, for example, about one-half of its original length, i.e., down to a point where surface 14 reaches the end of metal rod 40, the metal in metal rod 40 will come in contact with the bath. Prior art constructions avoided this in fear of metal contamination with the only alternative being to remove the electrode although only half used up. However, the present invention contemplates that the metal used in rod 40 will not contaminate the bath. In its most simplified version, this is accomplished by constructing the metal rods 40 of the same metal that is being produced by electrolytic reduction in the bath or cell, e.g., in an aluminum reduction cell, metal rods 40 comprise aluminum. This results in the partial melting of the rods 40, which insures good contact with the carbon electrode.

Figure 4:
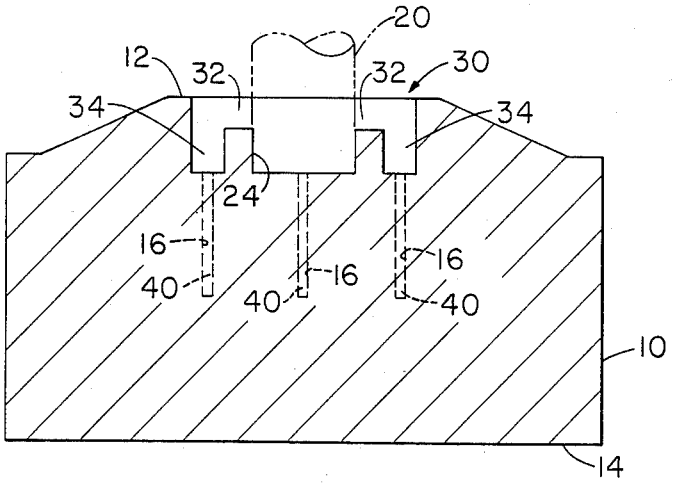
FIG. 4 is a cross-sectional view of one embodiment of the invention.
Figure 5:
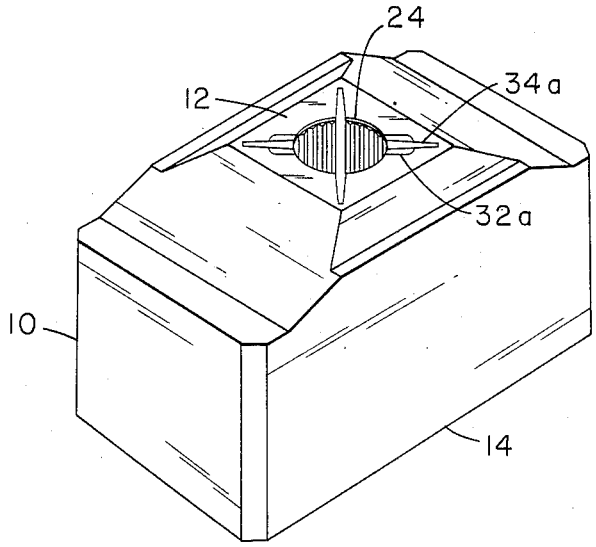
FIG. 5 is a perspective view of the electrode block used in the embodiment of FIG. 4.
Figure 6:
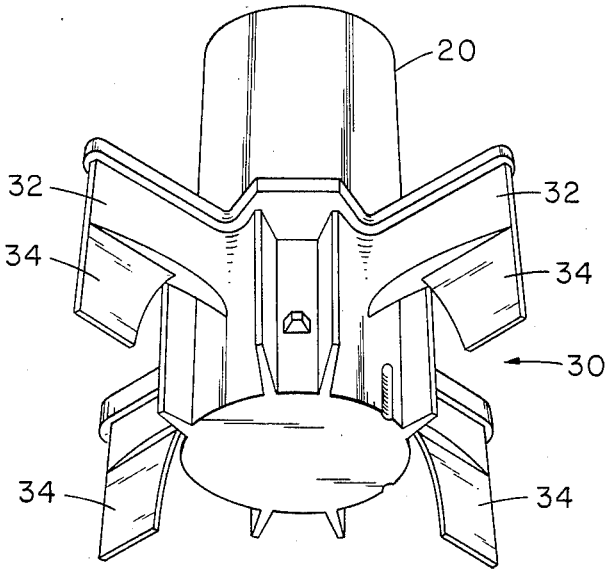
FIG. 6 is an oblique view of one component used in the embodiment of FIG. 4.

Turning now to FIGS. 4 through 6, one embodiment of the concept of the invention is illustrated. In FIGS. 4 and 6, it will be seen that an electrode 10 is provided with fin means 30 which comprise gate members 32 and wing members 34. Central shaft 20 is attached to fin assemblies 30. Metal rods 40 extend downwardly, respectively, from wing members 34 and shaft 20 which is received in bore 24 in electrode 10. As best seen in FIG. 6, there are actually four such fin assemblies which are symmetrically spaced radially around shaft 20 and bore 24 at 90° intervals to evenly distribute the current from shaft 20 into electrode 10. Thus, in the illustrated embodiment, there may be a central metallic rod 40 extending downwardly from the terminus of shaft 20 and four metal rods 40 respectively extending downwardly from each of the wing members 34 on a fin assembly 30.

It will be noted herein that electrode 10 is illustrated in the form of an anode. However, the current distribution and heat dissipation characteristics of the invention described herein can be used in cathode construction as well. The current carrying assembly of the invention will, therefore, be referred to as an electrode assembly although illustrated in the form of an anode.

The exact number of fin assemblies need not be four, but there should be a sufficient number to provide the desired even distribution of current through the electrode. It should be noted that rods 40 need not all be the same length. As each member 40 progressively drains out (when different lengths are used), the voltage loss through the electrode is held more nearly constant by the existence of other, shorter, rods 40 until all have drained out. This will aid in balancing the resistances between various electrode assemblies in the same cell having varying times of use and degree of electrode consumption.

In the illustrated embodiment, openings or bores 16 are first formed in electrode 10, and metal rods 40 are then formed by pouring molten metal into the small bores 16. In a particularly preferred embodiment, molten aluminum is poured into bores 16 to form metal portions or rods 40. A graphite diffusion barrier (not shown) may be placed in the upper portion of the bore 16 over the cast metal rod 40 if maximum purity of aluminum produced is desired. It should be noted, however, that such a barrier will result in some voltage losses. Steel shaft 20 is then inserted into bore 24, and cast iron is then poured into the remaining openings to form, in situ, gate members 32 and wing members 34 which comprise fin assemblies 30.

Since the aluminum comprising members 40, at the operating temperature of the bath, will probably be in molten form, the graphite diffusion barrier may be used to insure that, upon burn off of the bottom portion of electrode 10, the molten aluminum flowing into the bath and out of the bores 16 will not carry any of the cast iron impurities into the bath which might affect the purity of the aluminum being produced by the cell.

Figure 7:
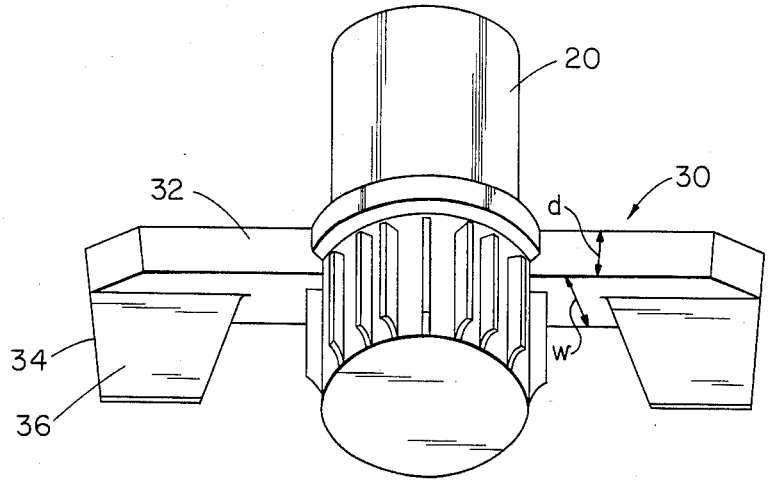
FIG. 7 is an oblique view of another embodiment of the invention.

FIG. 7 illustrates in more detail the best mode of construction of fin assemblies 30. As seen in the figure, in this embodiment the gate or bridging members 32 have a wide cross section "w" and a rather shallow depth "d" to permit maximum current carrying capabilities adjacent the top surface 12 of electrode 10 which will be the coolest portion of the electrode. Wing members 34 have a wide planar surface 36 which is generally normal to the axis of shaft 20 to maximize the current distribution from wing member 34 into electrode 10. While this particular aspect of the current distribution characteristics of fin assemblies 30 may appear to be of little importance upon initial functioning of a new electrode, it will be apparent that the function of metal rods 40 (in FIG. 4), the predominant current distributing factor for a new electrode, will be of no effect after the electrode has burned back sufficiently to expose the metal rods 40. At this point in time, the entire current distributing may well be done by central shaft 20 and the fin assemblies 30 if a metal, such as aluminum, has been used for rods 40 and the molten aluminum, after burnback of the electrode, has already run off into the bath. Thus, the large planar area 36 and its disposition with respect to shaft 20 is also important in another aspect of the invention, as will be presently discussed.

Figure 8:
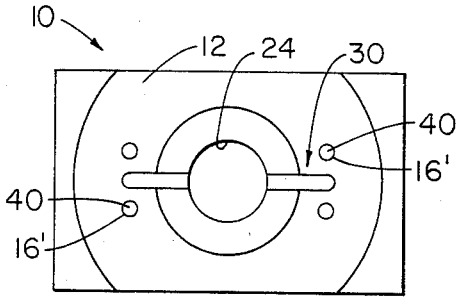
FIG. 8 is a top view of yet another embodiment of the invention.
Figure 9:
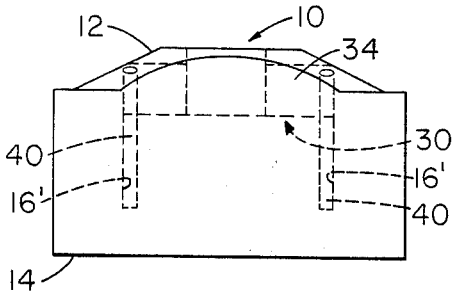
FIG. 9 is a side elevational view of the embodiment of FIG. 8.

Referring now to FIGS. 8 and 9, another embodiment of the invention is illustrated wherein bores 16' and metal rods 40 therein extend from the top surface 12 of electrode 10 to a point spaced from bottom surface 14 which may be about one-half of the entire depth of electrode 10 as in previous embodiments. However, this particular embodiment is characterized by the location of bores 16' and metal rods 40 therein at points spaced from fin assemblies 30, i.e., not in metallic contact with fin assemblies 30. While some extra resistance is introduced into this embodiment by the necessity of the transverse or lateral flow of the current from the fin assemblies 30 to metal rods 40, the design eliminates the need for any separate barrier means since burn off of the electrode to a point where metal rod 40 is exposed will present no risk of contamination from fin assemblies 30 since there is no direct metallic contact between fin assemblies 30 and metal rods 40 through the electrode.

On the other hand, in this embodiment, the large planar surfaces on wing members 34 assist in the distribution or flow of the current from wing members 34 laterally across the small intervening distance in the nonmetallic portions of electrode 10 to metal rods 40, and thus, the amount of added resistance introduced in this embodiment is kept to a minimum.

Figure 10:
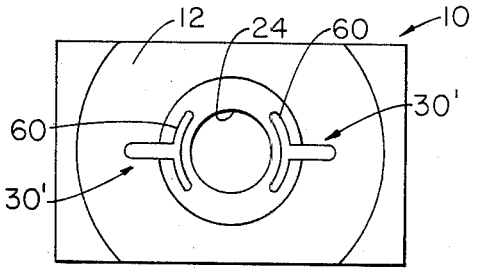
FIG. 10 is a top view of another embodiment of the invention.
Figure 11:
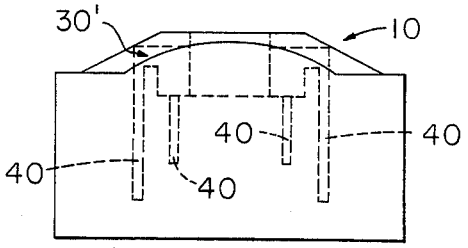
FIG. 11 is a side elevational view of the embodiment of FIG. 10.

Yet another embodiment is illustrated in FIGS. 10 and 11 wherein collar members 60 comprise arc sections symmetrically placed around bore 24 and shaft 20 therein. Collar members 60, as best seen in FIG. 10, are mounted in close proximity to bore 24 but not in direct communication therewith. As in the embodiment shown in FIGS. 8 and 9, this particular embodiment features protection against contamination from the steel or other members comprising shaft 20 because there is no metallic contact between steel shaft 20 and collar members 60 and the associated current distributing means attached thereto, i.e., fin assemblies 30' and rods 40. In this embodiment, collar members 60, fin assemblies 30' attached thereto, and rods 40 which extend downwardly from collars 60 and fin assemblies 30' may all be constructed of metals which will not contaminate the bath, i.e., preferably from the same metal as is being produced in the bath.

Thus, the invention, in general, provides for enhanced distribution of current from a central metallic shaft embedded in the top of the electrode by the use, at least in part, of metal materials which may extend further into the electrode than was previously thought possible by the prior art; by the use of metals which will not contaminate the bath, preferably comprising the same metal as is being produced in the bath; and by the isolation of such metals from the central shaft and any metals directly attached thereto. Minor modifications of the embodiments illustrated will, of course, be readily apparent to those skilled in the art upon a reading of the foregoing description.

Having thus described the invention, what is claimed is:

1. An improved electrode assembly for use in a cell for the production of metal by electrolytic reduction in a molten salt bath comprising:

(a) a nonmetallic conductive electrode having a top surface;

(b) a central current carrying support shaft received in a central bore in said electrode extending axially downward from said top surface;

(c) fin assemblies extending radially from said central support shaft in said nonmetallic conductive electrode, said fin assemblies comprising a plurality of gate members extending radially from said central shaft adjacent said top surface of said nonmetallic conductive electrode and wing members extending from said gate members downwardly into said nonmetallic conductive electrode from said top surface; and (d) metal conductive means, comprising a metal which will not contaminate the salt bath, extending downwardly in said electrode beyond the depth of said central shaft and fin assemblies; whereby current passing to said nonmetallic conductive electrode from said central shaft may be distributed evenly in said electrode to minimize the voltage drop in said electrode and permit the cell to run cooler.

2. The improved electrode assembly of claim 1 wherein said metal conductive means are isolated from said central shaft whereby subsequent exposure of said metal conductive means by burn back of said electrode will not result in contamination entering said salt bath from said shaft or metals in contact therewith.

3. The improved electrode assembly of claim 2 wherein said fin assemblies are separated from said metal conductive means by carbonaceous means therebetween.

4. The improved electrode assembly of claim 2 wherein said cell produces aluminum and said metal conductive means comprise aluminum.

5. The improved electrode assembly of claim 4 wherein said gate members are made of cast iron.

6. The improved electrode assembly of claim 5 wherein said cast iron is poured into openings cut in the top face of said nonmetallic conductive electrode.

7. The improved electrode assembly of claim 6 wherein said wing members extend downwardly into said nonmetallic conductive electrode from said top surface a distance at least equal to the depth of said central support shaft in said central bore and at least a portion of said metal conductive means are located beneath said wing members; whereby the resistance path for the current to the bottom of said electrode is reduced.

8. The improved electrode assembly of claim 7 wherein planar surfaces are provided on each of said wing members which extend substantially normal to the axis of said central support shaft whereby current passing into said nonmetallic conductive electrode from said planar surfaces will flow away from said central shaft to more evenly distribute current to said nonmetallic conductive electrode.

9. The improved electrode assembly of claim 8 wherein at least four wing members radially extend from said central shaft in symmetrical spacing to provide a more even current distribution to said nonmetallic conductive electrode.

10. The improved electrode assembly of claim 7 wherein a series of bores radially spaced equidistantly around said central bore extend downwardly into said nonmetallic conductive electrode from said top surface parallel to said central bore and metal conducting members are carried in said bores whereby current passing into said carbon electrode from said central shaft and said fin assemblies will flow to said metal conducting members and be further distributed in said electrode by said metal conducting members.

11. The improved electrode assembly of claim 10 wherein said bores containing said metal conducting members extend downwardly into said electrode a distance greater than the depth of said central shaft and said fin assemblies.

12. The improved electrode assembly of claim 10 wherein said metal in said bores is in conductive communication with said fin assemblies.

13. The improved electrode assembly of claim 12 wherein said cell comprises an aluminum reduction cell and said metal which will not contaminate said bath comprises aluminum.

14. The improved electrode assembly of claim 13 wherein said nonmetallic conductive electrode consists essentially of carbon.

15. An improved electrode assembly for use in an electrolytic reduction cell for the production of aluminum comprising a nonmetallic conductive electrode having a central shaft received in a central bore in the top surface of said electrode and metallic members comprising generally circular collar members which at least partially surround said central bore and extend downwardly in said electrode from said top surface and which are symmetrically spaced apart from said central shaft whereby current from said central shaft will flow through said nonmetallic conductive electrode to said metallic collar members and then be further distributed to other portions of said nonmetallic conductive electrode through said metallic members.

16. The electrode assembly of claim 15 wherein said metallic members comprise aluminum.

17. The electrode assembly of claim 16 wherein said aluminum members include aluminum rods disposed generally parallel to said central bore and extending downwardly toward the bottom of said electrode.

18. The electrode assembly of claim 15 wherein fin members are attached to said collar members and said fin assemblies comprise gate members which radially extend out from said collar member adjacent the top surface of said electrode and wing members having planar surfaces extending downwardly from said gate members toward the bottom of said electrode.

19. The electrode assembly of claim 18 wherein aluminum rods extend downwardly into said electrode toward the bottom surface thereof.

20. The electrode assembly of claim 19 wherein said collar members and fin assemblies attached thereto comprise aluminum.

21. An improved cathode assembly for use in an electrolytic reduction cell for the production of aluminum comprising a carbon cathode having a central shaft received in a central bore within said cathode and metallic members comprising generally circular collar members which at least partially surround said central bore and extend outwardly in said cathode from said central shaft and which are symmetrically spaced apart from said central shaft whereby current from said central shaft will flow through said carbon cathode to said metallic collar members and then be further distributed to other portions of said carbon cathode through said metallic members.

22. An improved anode assembly for use in an electrolytic reduction cell for the production of aluminum comprising a carbon anode having a central shaft received in a central bore within said anode and metallic members comprising generally circular collar members which at least partially surround said central bore and extend outwardly in said anode from said central shaft and which are symmetrically spaced apart from said central shaft whereby current from said central shaft will flow through said carbon anode to said metallic collar members and then be further distributed to other portions of said carbon anode through said metallic members.

* * * * *